US009957077B2

(12) United States Patent
Dornbach

(10) Patent No.: US 9,957,077 B2
(45) Date of Patent: May 1, 2018

(54) PLASTIC CONTAINER

(71) Applicant: Alpla Werke Alwin Lehner GmbH & Co. KG, Hard (AT)

(72) Inventor: Christian Dornbach, Hard (AT)

(73) Assignee: ALPLA WERKE ALWIN LEHNER GMBH & CO. KG, Hard (AT)

( * ) Notice: Subject to any disclaimer, the term of this patent is extended or adjusted under 35 U.S.C. 154(b) by 0 days. days.

(21) Appl. No.: 14/725,565

(22) Filed: May 29, 2015

(65) Prior Publication Data

US 2015/0259090 A1 Sep. 17, 2015

Related U.S. Application Data

(63) Continuation of application No. PCT/EP2013/003122, filed on Oct. 17, 2013.

(30) Foreign Application Priority Data

Nov. 30, 2012 (CH) ..... 2630/12
Mar. 5, 2013 (CH) ..... 543/13

(51) Int. Cl.
*B65D 1/02* (2006.01)
*B65D 1/46* (2006.01)

(52) U.S. Cl.
CPC ..... *B65D 1/0284* (2013.01); *B65D 1/0207* (2013.01); *B65D 1/0261* (2013.01); *B65D 1/0276* (2013.01)

(58) Field of Classification Search
CPC .. B65D 1/0284; B65D 1/0276; B65D 1/0207; B65D 1/0261; B65D 79/005; B65D 1/44;
(Continued)

(56) References Cited

U.S. PATENT DOCUMENTS 3,598,270 A * 8/1971 Adomaitis ..... B65D 1/0284 215/375
4,598,831 A * 7/1986 Nakamura ..... B65D 1/0276 215/373

(Continued)

FOREIGN PATENT DOCUMENTS

WO WO 2011/007734 A1 1/2011

OTHER PUBLICATIONS

International Search Report (PCT/ISA/210) dated Nov. 22, 2013, by the European Patent Office as the International Searching Authority for International Application No. PCT/EP2013/003122.

(Continued)

*Primary Examiner* — J. Gregory Pickett
*Assistant Examiner* — Gideon Weinerth
(74) *Attorney, Agent, or Firm* — Buchanan Ingersoll & Rooney PC

(57) ABSTRACT

A plastic container for storing liquid under a low overpressure having a container body, to whose one longitudinal end a container neck is connected, which neck has a pour opening. A bottom section has a container bottom and an edge area pulled up on the sides and that turns into the container body, is connected to the other longitudinal end of the container body. The container bottom has a curved concave section, whose periphery is connected via an axially projecting, graduated transition area to a platform that runs into the edge area pulled up on the sides. The platform and at least one partial area of the graduated transition area are interrupted by a first number of grooves. In the concave section, a second number of panel-like projections are made, which essentially extend between the graduated transition area and the longitudinal axis and end before the graduated transition area.

19 Claims, 3 Drawing Sheets

(58) Field of Classification Search
CPC . B65D 1/46; B65D 2501/0036; B29D 22/003
USPC ..... 215/371, 375, 376, 377, 277; 220/608, 220/720, 721, 609
See application file for complete search history.

(56) References Cited

U.S. PATENT DOCUMENTS

| | | | | |
|---|---|---|---|---|
| 5,850,932 | A | 12/1998 | Beck et al. | |
| D528,422 | S * | 9/2006 | Darr | D9/516 |
| D699,113 | S * | 2/2014 | Haner | D9/516 |
| D755,636 | S * | 5/2016 | Hanan | D9/414 |
| 9,617,029 | B2 * | 4/2017 | Lane | B65D 1/0284 |
| 2004/0060896 | A1 * | 4/2004 | Itokawa | B65D 1/0284 215/375 |
| 2004/0094502 | A1 * | 5/2004 | Boukobza | B65D 1/0284 215/375 |
| 2005/0127024 | A1 * | 6/2005 | Darr | B29C 49/0073 215/382 |
| 2007/0045220 | A1 * | 3/2007 | Pedmo | B65D 1/0284 215/375 |
| 2007/0170144 | A1 | 7/2007 | Lane et al. | |
| 2007/0231530 | A1 * | 10/2007 | Pedmo | B65D 1/0276 428/66.3 |
| 2007/0262046 | A1 * | 11/2007 | Zoppas | B65D 1/0284 215/375 |
| 2009/0283495 | A1 | 11/2009 | Lane et al. | |
| 2009/0308835 | A1 * | 12/2009 | Boukobza | B65D 1/0284 215/370 |
| 2010/0230378 | A1 * | 9/2010 | Colloud | B65D 1/0223 215/384 |
| 2010/0297375 | A1 * | 11/2010 | Protais | B65D 1/0284 428/36.92 |
| 2011/0011873 | A1 * | 1/2011 | Miura | B65D 1/0284 220/609 |
| 2011/0309090 | A1 * | 12/2011 | Derrien | B65D 1/0284 220/600 |
| 2013/0087568 | A1 * | 4/2013 | Hermel | B65D 1/42 220/600 |
| 2013/0264305 | A1 * | 10/2013 | Boukobza | B65D 1/0284 215/375 |
| 2015/0136727 | A1 * | 5/2015 | Hermel | B65D 1/0284 215/373 |
| 2015/0144587 | A1 * | 5/2015 | Hanan | B65D 1/0284 215/377 |
| 2015/0259090 | A1 * | 9/2015 | Dornbach | B65D 1/0261 215/371 |
| 2015/0298848 | A1 * | 10/2015 | Hermel | B65D 1/0284 215/373 |
| 2016/0137331 | A1 * | 5/2016 | Hanan | B65D 1/0246 215/44 |
| 2016/0144992 | A1 * | 5/2016 | Hermel | B65D 1/0284 215/375 |
| 2016/0167825 | A1 * | 6/2016 | Dachs | B65D 1/0284 215/375 |
| 2016/0244197 | A1 * | 8/2016 | Hermel | B65D 1/0284 |
| 2016/0272356 | A1 * | 9/2016 | Simpson | B65D 25/2885 |
| 2016/0288946 | A1 * | 10/2016 | Pierre | B65D 1/0284 |
| 2016/0304233 | A1 * | 10/2016 | Hermel | B65D 1/0284 |
| 2017/0121049 | A1 * | 5/2017 | Bouquin | B65D 1/0284 |
| 2017/0334628 | A1 * | 11/2017 | Bangi | B65D 79/005 |

OTHER PUBLICATIONS

Written Opinion (PCT/ISA/237) dated Nov. 22, 2013, by the European Patent Office as the International Searching Authority for International Application No. PCT/EP2013/003122.

* cited by examiner

PLASTIC CONTAINER

RELATED APPLICATION(S)

This application claims priority as a continuation application under 35 U.S.C. §120 to PCT/EP2013/003122, which was filed as an International Application on Oct. 17, 2013 designating the U.S., and which claims priority to Swiss Applications 02630/12 filed in Switzerland on Nov. 30, 2012 and 00543/13 filed in Switzerland on Mar. 5, 2013. The entire contents of these applications are hereby incorporated by reference in their entireties.

FIELD

The disclosure relates to a plastic container, for example a plastic bottle, for storing liquid products under a low overpressure. Containers made of tin or multicolored sheet metal, glass or ceramic, common in the past, are being replaced by containers made of plastic. Plastic containers, for example plastic bottles, can be used, for example, for the packaging of fluid substances, for example beverages, oil, cleaning utensils, cosmetics, etc. The low weight and the lower costs can play a role in this substitution. The use of recyclable plastic materials and the overall more advantageous total energy balance in their production can also contribute to promoting the acceptance of plastic containers, such as plastic bottles, by consumers.

BACKGROUND INFORMATION

Plastic containers, for example plastic bottles, can have a container body, to whose one longitudinal end can be connected a container neck, which is equipped with at least one pour opening. The container body can have a regular (for example, circular or else essentially square), cross-sectional surface. It can also have an oval cross-section, however. A bottom section can be connected to the other end of the container body. The bottom section can include a container bottom and an edge area that is pulled up on the sides and that turns into the container body.

The plastic container can be produced in an extrusion-blow-molding method from a single-layer or multi-layer plastic hose that can be extruded continuously or intermittently. In this case, a section of the extruded plastic hose can be introduced into the mold cavity of a blow mold tool and inflated by a gas, introduced with overpressure, such as air, into the shape of the mold cavity. The air blast is supplied by a calibrating blow pin, which is run into the plastic hose section that is located in the mold cavity. The formed and cooled plastic container is then removed from the mold (i.e., demolded).

The plastic container can also be produced in a single-stage or multi-stage stretch-blow-molding method. In this case, an elongated preshaped body (preform) can first be produced in an injection-molding or impact-extruding method. The preshaped body is used in another step in the mold cavity of a blow mold tool and inflated by a gas that is introduced with overpressure, such as air, into the shape of the mold cavity. During the inflation process, the preshaped body is, in addition, axially stretched by a run-in elongated mandrel. The plastic container that is finish-stretch-blow-molded and cooled into the shape of the mold cavity is then removed (i.e., demolded) in finished form. A single-stage stretch-blow-molding method is when the further processing of the still hot preshaped body is done directly after the production of the preshaped body. During the two-stage stretch-blow-molding method, the preshaped body that is produced is further processed at a different time and/or place, whereby it must be heated again for the actual stretch-blow-molding process.

In some cases, liquid products are stored in plastic containers under a slight overpressure. This slight overpressure is produced, for example, in that after the plastic container is decanted, it is filled with nitrogen gas. The oxygen is displaced by the nitrogen, which otherwise could lead to an oxidation of the contents and thus could reduce the shelf life of the decanted product. However, even products that outgas during storage can lead to a slight overpressure within the plastic container. This overpressure is, for example, 0.3-0.5 bar and can reach up to 1.5 bar. Because of the overpressure, there is a certain risk that the container body will deform in an uncontrolled manner, for example will curve outward, and will thus diminish the structural safety of the container.

Known plastic containers can have weakened areas in the container body, at which the container body can deform to a limited extent. The container body can be designed with a relatively large wall thickness. Such plastic containers that have deformable sections in the container body can be relatively complex in production. In addition, the deformable sections can often greatly limit the space that is available for labeling the plastic container.

Alternative approaches therefore attempt to counteract a deformation of the container body in that the container bottom is designed with deformable areas that are more or less controlled. For example, container bottoms that are designed like membranes and that have several concentrically arranged areas that are connected in a hinged manner to one another and that are curved inward and can bulge outward because of an increased internal pressure are known. Because this deformation process of the container bottom could diminish the stability of the container, the areas of the container bottom that are connected in a hinged manner to one another are arranged between feet that are made in the edge area of the bottom section. For example, plastic containers with five or more feet are known. Aside from the relatively complex design of its bottom section, the container has a greater height because of the feet, without thus significantly increasing in the inside volume. The feet are designed with a relatively large wall thickness because the weight of the filled container is now distributed on a significantly reduced surface. In contrast, however, the desire exists to further reduce the material requirement for the plastic container for ecological and economic considerations.

SUMMARY

A plastic container is disclosed for storing liquid products under a low overpressure, the container comprising: a container body extending along a longitudinal axis; a container neck connected to one longitudinal end of the container body, the neck having at least one pour opening, a bottom section connected to another longitudinal end of the container bottom, the bottom section having a container bottom and an edge area that is pulled up on the sides and that turns into the container body, wherein in a direction of a container interior that is bounded by the container body, the container bottom has a curved concave section, whose periphery is connected via an axially projecting, graduated transition area to a platform that runs into the edge area that is pulled up on the sides, the platform and at least one partial area of the graduated transition area interrupted by a first number of grooves, and the concave section having a second number of panel-like projections, which essentially extend between the graduated transition area and the longitudinal axis and end before the graduated transition area.

BRIEF DESCRIPTION OF THE DRAWINGS

Additional advantages and features of the disclosure follow from the subsequent description with reference to the diagrammatic drawings that are not true to scale, wherein.

In the subsequent description of the figures, the same reference numbers in each case refer to the same components.

DETAILED DESCRIPTION

Figure 1:
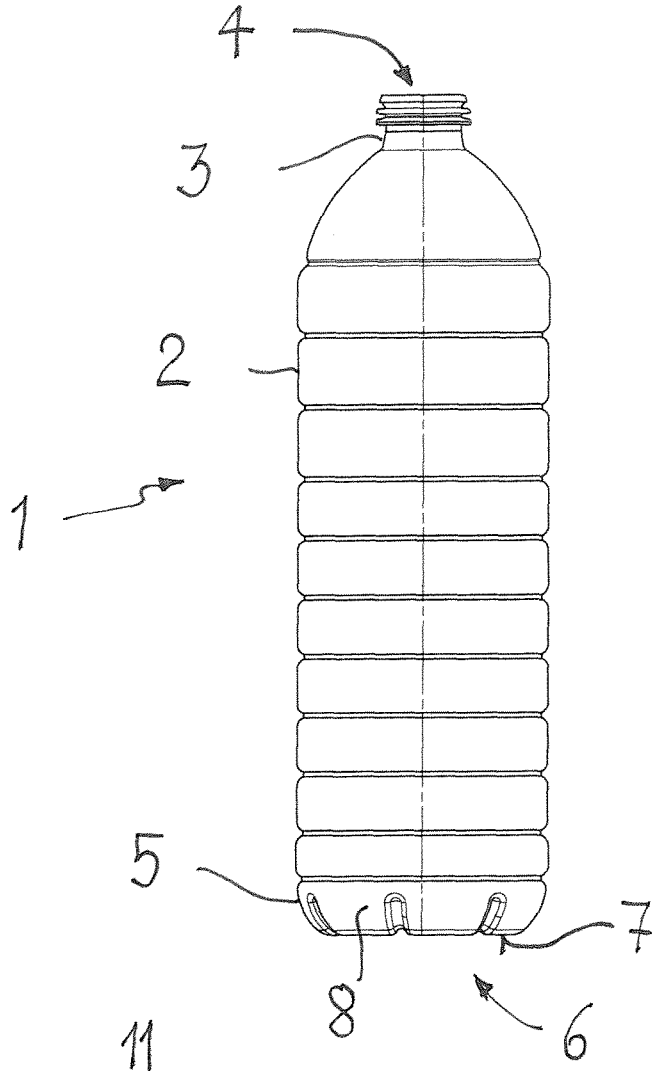
FIG. 1 shows a side view of a plastic container according to an exemplary embodiment of the disclosure.

Exemplary embodiments of this disclosure can address drawbacks of known plastic containers, such as plastic bottles. A plastic container can be provided for storing liquid products under a slight overpressure, whose container body is available to a large extent in its entirety for labeling. The plastic container can have a bottom section that has, for example, as large a platform as possible. It is to be possible to eliminate feet in the edge area of the bottom section. Moreover, additional material savings in the production of the plastic container can be met.

A plastic container, according to an exemplary embodiment of the disclosure for storing liquid products under a slight overpressure, has a container body with a longitudinal axis, to whose one longitudinal end a container neck is connected, which neck is equipped with at least one pour opening. A bottom section is connected to the other longitudinal end of the container body, which bottom section has a container bottom and an edge area that is pulled up on the sides and that turns into the container body. In the direction of a container interior that is bounded by the container body, the container bottom has a curved concave section, whose periphery is connected via an axially projecting, graduated transition area to a platform that runs into the edge area that is pulled up on the sides. The platform and at least one partial area of the graduated transition area are interrupted by a first number of grooves. In the concave section, a second number of panel-like projections are made, which projections essentially extend between the graduated transition area and the longitudinal axis and end before the graduated transition area.

The plastic container, according to an exemplary embodiment of the disclosure, has a bottom section, whose combination of features makes it possible to meet the, to some extent, contradictory specifications. The concave section, which can be designed dome-shaped, is connected to the platform via the graduated transition area. In this connection, the platform can be designed essentially circular when the plastic container has an essentially circular cross-section.

In general, the platforms have the geometric shape that also has the cross-section in the area of the edge area that is pulled up on the sides in the container body. The graduated transition area has a hinge-like function, which allows a small deformation of the concave section in the case of increased overpressure. In contrast, the panel-like projections again impart an increased stiffness to the concave section. The at least one partial area of the graduated transition area and the platform-interrupting grooves can impart a greater stiffness to the bottom section overall. The graduated transition area can include, for example, two stages, in which a first stage that is connected to the platform is interrupted by the groove, and the second stage that is adjacent to the concave section is not interrupted. The grooves can also interrupt the entire graduated transition area; i.e., can reach into the concave section. As a result, the grooves can ensure a limitation of the hinge-like function, because the graduated transition area is not designed in a through-going or circumferential manner but rather is divided by the grooves into individual segments.

The stiffness of the bottom section can be influenced by the size and the number of grooves. In this connection, the grooves can be distributed uniformly or unevenly along the periphery. The combination of features can increase the stiffness and in turn conveying the latter directly impart to the bottom section the desired stability to maintain low overpressures without deformation and in contrast to make possible a limited deformation of the container bottom at elevated internal pressures. As a result, it can be ensured that the container body itself remains free of deformation. As low overpressures, internal pressures of up to 1.5 bar, for example 0.3 to 0.5 bar, above the ambient pressure are considered for this disclosure.

The platform of the plastic container is, for example, interrupted only by the grooves. As a result, the weight of the filled, upright container can be distributed on a comparatively large surface. This measure together with the features that increase the stiffness in the form of grooves and the panel-like projections can meet the requirement for a reduction in the wall thicknesses, without the overpressure resistance or buckling resistance of the plastic container suffering thereby. Thus, for example, the container weight can be reduced by up to 2 g, for example from 17.2 g to 15.2 g, without a significant impairment of the required resistances occurring. By corresponding production methods, it can be achieved that the wall thickness of the plastic container is, for example, less than or equal to 0.2 mm. Excluding this, a seal threading can be in the neck area. Such plastic containers can be produced from heated preshaped bodies (preforms) in a stretch-blow-molding method.

According to an exemplary embodiment of the disclosure, the grooves of the plastic container can extend essentially along the longitudinal axis in the edge area of the bottom section that is pulled up on the sides. In this connection, the stiffness or stability of the container section can be additionally increased.

In another exemplary embodiment of the disclosure, the first number of grooves and the second number of panel-like projections can be different from one another. The stiffness of the concave section of the bottom section independently of the stiffness of the edge area that is pulled up can be preset by the second number of panel-like projections. In many cases, however, the first number of grooves and the second number of panel-like projections are to be the same in order to impart a pleasing appearance to the plastic container, in particular the container bottom.

In an exemplary embodiment of the disclosure, the concave section of the container bottom can encompass a central dome that extends into the interior of the container.

The central dome has a significantly greater curvature than the dome-like concave section. As a result, the stiffness of the now circular concave section can be further increased. In the case of the production of the plastic container in a stretch-blow-molding method, the crown area of the central dome can be used as an attachment for an elongated mandrel. As a result, an overly fast cooling and freezing of the bottom section in the contact area with the elongated mandrel can be avoided.

For production reasons, it has proven suitable when the panel-like projections in each case end before a transition of the concave section to the central dome. Thus, for example, an accumulation of material can be avoided during biaxial stretching processes.

For achieving the specified flexibility, it has proven suitable when an axial height that is bridged between the concave section and the platform by the graduated transition area can be, for example, 0.2 mm to 10 mm, such as 0.5 mm to 5 mm, and in exemplary embodiments is 1 mm. A radial extension of the graduated transition area that extends essentially crosswise to the longitudinal axis of the plastic container can be in this case approximately, for example 0.2 mm to 10 mm, such as 0.5 mm to 5 mm, and in exemplary embodiments is 1.3 mm.

To strengthen the bottom section, the grooves that extend from the graduated transition area into the edge area that is pulled up on the sides can have a depth that is for example 0.5 mm to 5 mm, such as 1 mm to 3 mm, and in exemplary embodiments is 2 mm.

In another exemplary embodiment of the disclosure, the grooves can include a specific depth, which is the same as or greater than an axial height of the graduated transition area that extends between the concave section and the platform. In this connection, it can be produced that the groove floor in the direction of the pour opening is viewed as deeper than the surface of the concave section that points outward. Thus, the grooves can extend into the concave section and thus further reinforce the stability of the container bottom. Because of this configuration, the platform and the graduated transition area are divided into individual segments.

To strengthen the bottom section, it can be of further advantage if the grooves have an opening angle that is, for example, 20° to 50°, such as 27° to 43°, and in exemplary embodiments is 35°.

The panel-like projections can be used for further stiffening of the concave section of the container bottom. They can be designed over relatively large areas and have a maximum extension, measured in the vicinity of the graduated transition, in the peripheral direction, which is, for example, 2 mm to 10 mm, such as 5 mm to 8.5 mm, and in exemplary embodiments is 7.25 mm. The panel-like projections can include a maximum protrusion compared to the concave section that is for example 0.5 mm to 5 mm, such as 1.3 mm to 3.8 mm, and in exemplary embodiments is 2.4 mm.

A balanced distribution of the overall weight of the filled plastic container can be also already produced in that a plastic container, which has an essentially circular cross-section at least within the edge area that is pulled up on the sides, has a platform with a mean footprint diameter that is, for example, 60% to 80% of an outside diameter of the bottom section at the transition of the edge area that is pulled up to the container body. In this case, the platform includes a radial width that is, for example, 5% to 15% of its mean footprint diameter.

The grooves do not have to end exactly at the graduated transition. They can also have an outlet that extends in the direction of the longitudinal axis of the plastic container, which outlet projects, for example, 0.2 mm to 4 mm into the concave section. This can also contribute to the stiffening of the concave section.

For the stability of the plastic container, it can prove to be advantageous when the first number of grooves is odd. In an exemplary embodiment of the disclosure, the bottom section of the plastic container includes seven grooves, which are distributed in an essentially uniform manner over the periphery of the bottom section.

The plastic container includes different cross-sections. Exemplary cross-sections are regular cross-sections, such as, for example, circular or essentially square cross-sections. Such plastic containers are used for, for example, storing cooking oil, in which oxygen is displaced after filling by nitrogen. Thus, in the filled plastic container, an overpressure of up to, for example, 1.5 bar, for example, 0.3 to 0.5 bar, which is lower compared to the ambient pressure, is produced.

In an extrusion-blow-molding method, the plastic container can be produced from a plastic hose that is extruded continuously or intermittently. Because of the higher stretch-solidification that can be achieved, the plastic container that is designed according to the disclosure can be produced in a stretch-blow-molding method from a previously-produced elongated preshaped body. The production of the preshaped body or preform can be carried out in a different fashion. For example, in this respect, injection-molding methods, impact-extruding methods, or else extrusion-blow-molding methods are used.

A plastic container, in particular a plastic bottle, which is depicted in FIG. 1, bears the reference number 1 overall. The plastic container 1 has a container body 2 with a longitudinal axis, to whose one longitudinal end a container neck 3 is connected, which neck has a pour opening 4. A bottom section 5, which includes a container bottom 6 with a platform 7 and an edge area 8 that is pulled up on the sides, which turns into the container body 2, is connected to the other longitudinal end of the container body 2. The depicted plastic container 1 can be, for example, a plastic container for storing cooking oil. In many cases, such plastic containers 1 are produced in a stretch-blow-molding method that includes of a previously-finished, elongated preshaped body or preform with an essentially circular cross-section. In many cases, the preshaped body is finished in an injection-molding method. It can also be produced in, for example, an impact-extruding method or in an extrusion-blow-molding method. After the cooking oil is decanted, nitrogen with overpressure is introduced into the plastic container 1 before the sealing in order to displace oxygen. As a result, an overpressure that is lower compared to the ambient pressure, which can be up to 1.5 bar, for example approximately 0.3 bar to 0.5 bar, exists in the decanted, sealed plastic container.

Figure 2:
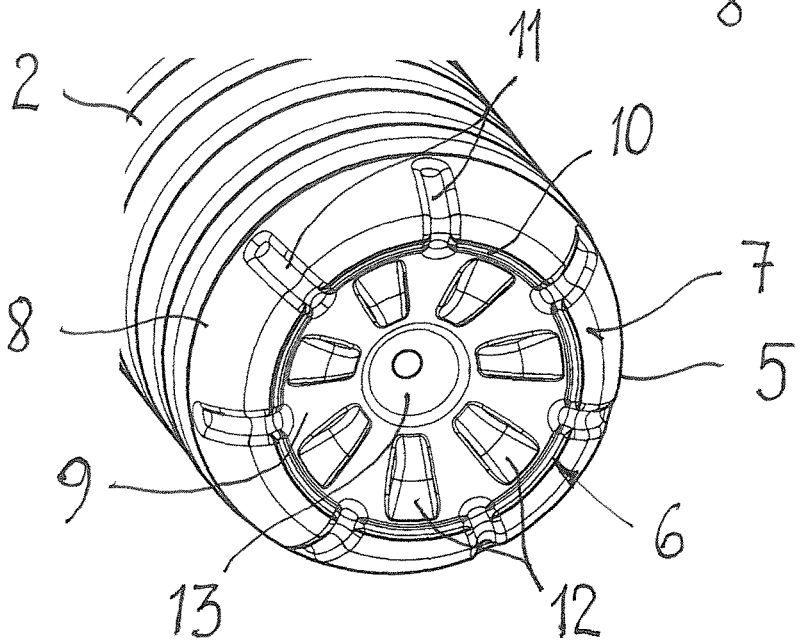
FIG. 2 shows a perspective view of a bottom section of the plastic container.

FIG. 2 shows a perspective view of the bottom section 5. The latter includes the container bottom 6 and the edge area 8 that is pulled up on the sides and that turns into the container body 2. The container bottom 6 extends from a central area of the bottom section 5 to the platform 7 and encompasses the latter. The container bottom 6 includes a dome-shaped, concave section 9 that is curved into the interior of the container and that encompasses a central dome 13 that extends into an interior space that is bounded by the container body 2 in an annular manner. A graduated transition area 10 that projects axially and that is designed in an essentially annular manner connects the concave section 9 to the platform 7. The graduated transition area 10 and the platform 7 are interrupted in the depicted embodiment by a first number of grooves 11, for example seven grooves 11, which are distributed essentially uniformly over the periphery of the bottom section 5, which grooves extend essentially radially into the edge area 8 of the bottom section 5 that is pulled up on the sides. In this connection, the platform 7 and the graduated transition area 10 are divided into individual segments. The grooves 11 further extend up to the dome-shaped concave section 9. The dome-shaped concave section 9 of the container bottom 6 has a second number of projections 12, designed like a panel, which extend from a transition of the concave section 9 into the central dome 13 approximately radially to the graduated transition section 10 and end shortly prior to that. The panel-like projections 12 in the concave section 9 are arranged in each case essentially in the center between two grooves 11. Correspondingly, in the depicted embodiment, the number of grooves 11 and the number of panel-like projections 12 are equal.

The graduated transition area 10 has a certain flexibility and performs a type of hinge function or spring function for the dome-shaped concave section 9. At too high an overpressure in the interior of the container, the concave section 9 can be pressed radially and axially outward within predetermined limits, whereby a radial and axial deformation of the container body 2 can be avoided by the spring function of the graduated transition area 10. The grooves 11 can limit the flexibility of the graduated transition area 10 and in turn impart a greater stiffness to the container bottom 6. They can also ensure an increase in stiffness in the area of the platform 7 and in the edge area 8 that is pulled up on the sides. Also, the panel-like projections 12 in the concave section 9 can ensure a stiffening of the container bottom 5. The combination of the listed features of the bottom section 5 can lead, on the one hand, to the desired limited deformability of the container bottom 6 and increases, on the other hand, the stiffness thereof. By a corresponding first number and the forming of grooves 11, a corresponding second number and forming of the panel-like projections 12 and a corresponding forming of the graduated transition area 10, the deformability as well as the stiffness of the bottom section 5 can be predetermined. As a result, the specification can be met for reducing the wall thicknesses of the plastic container without in this case having to accept significant losses with respect to the mechanical strengths of the bottom section 5.

Figure 3:
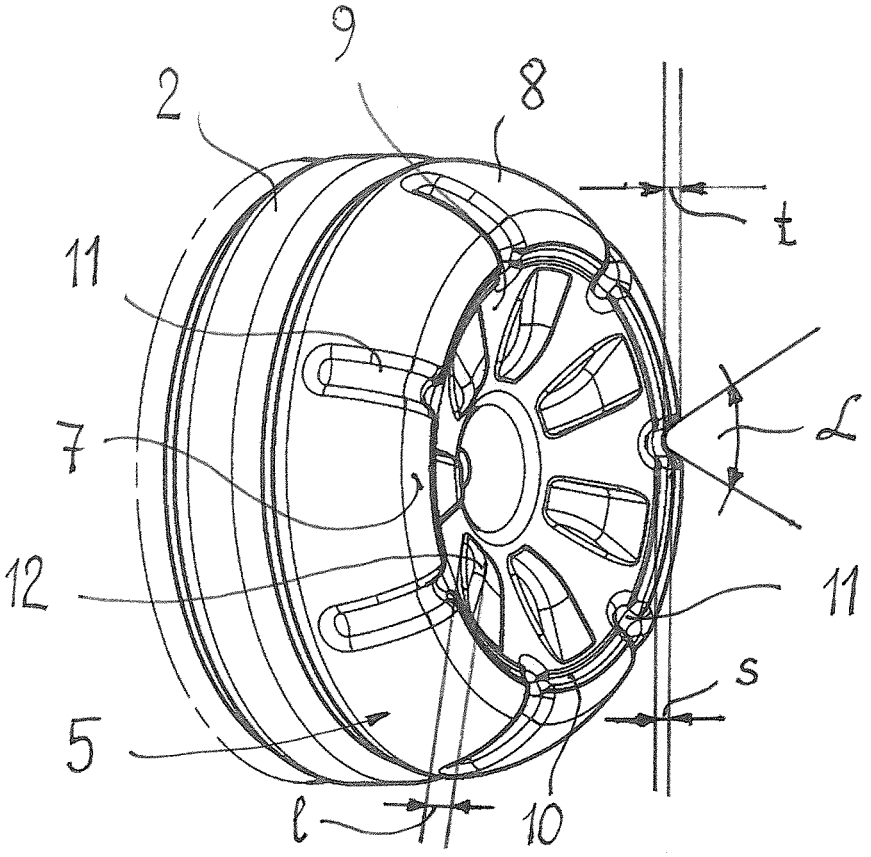
FIG. 3 shows another perspective view of the bottom section.

FIG. 3 shows another perspective view of the bottom section 5 for explaining the geometric dimensions of the graduated transition area 10 and the grooves 11. The graduated transition area 10 connects the dome-shaped concave section 9 to the platform 7. In this connection, the graduated transition area 10 with a first periphery is linked to the dome-shaped concave section 9 and with a second periphery, opposite to the first periphery, is linked to the platform 7. An axial height that is bridged by the graduated transition area 10 can be, for example, 0.2 mm to 10 mm, for example 0.5 mm to 5 mm, and for example approximately 1 mm. It can be pointed out that the graduated transition area 10 has at least one stage. It can also include two or more stages, however. The grooves 11 that extend from the graduated transition area 10 into the edge area 8 of the bottom section 5 that is pulled up in each case have a depth t, which can be, for example, 0.5 mm to 5 mm, for example, 1 mm to 3 mm, and for example, 2 mm. In this case, the grooves 11 have an opening angle ($\alpha$), which can be, for example, 20° to 50°, such as 27° to 43°, and in exemplary embodiments is 35°. The panel-like projections that are provided with the reference number 12 can have a maximum axial protrusion 1 relative to the concave section 9, which can be, for example, 0.5 mm to 5 mm, such as 1.3 mm to 3.8 mm, and in exemplary embodiments is 2.4 mm.

Figure 4:
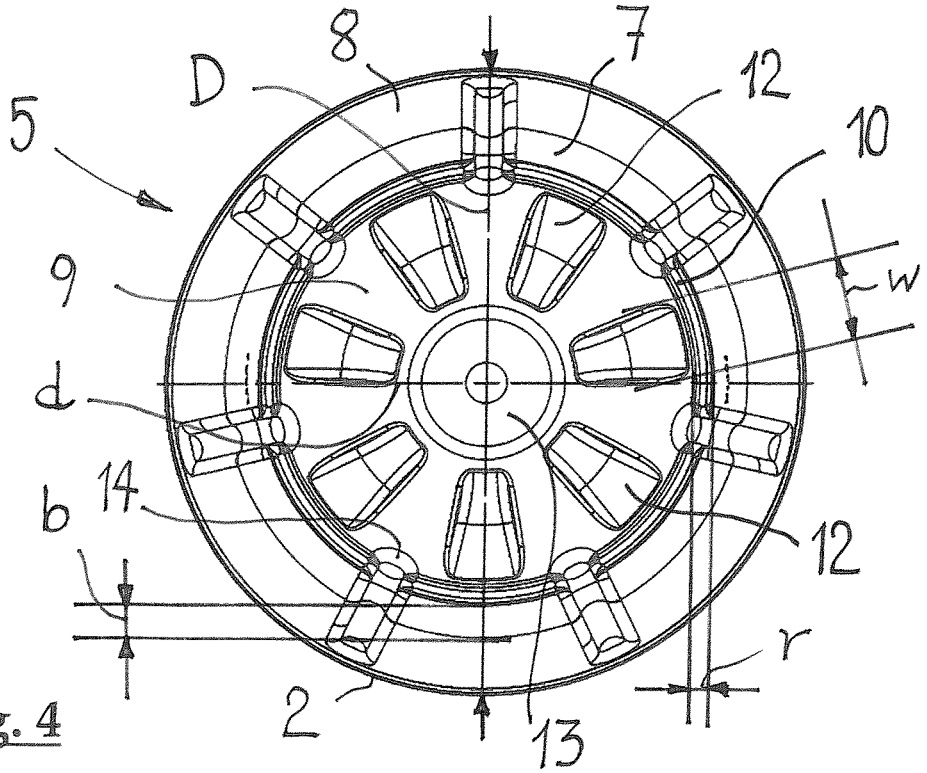
FIG. 4 shows a top view of the bottom section of the plastic container.

From the top view of the bottom section 5, depicted in FIG. 4, it can be seen that the graduated transition area 10 has a radial extension r, which can be approximately 0.2 mm to 10 mm, such as 0.5 mm to 5 mm, and in exemplary embodiments is 1.3 mm. The panel-like projections 12 in the concave section 9 widen from the central dome 13 in the direction of the graduated transition area 10 and at their widest point, in the vicinity of the graduated transition area 10, can have a width w that is approximately 2 mm to 10 mm, such as 5 mm to 8.5 mm, and in exemplary embodiments is 7.25 mm. The platform 7 has a mean footprint diameter d that can be, for example, 60% to 80% of an outside diameter D of the bottom section 5 at the transition of the edge area 8 that is pulled up to the container body 2. In this case, the platform includes a radial width b, which can be approximately 5% to 15% of its mean footprint diameter d.

In addition, FIG. 4 shows that the grooves 11 do not have to end exactly at the graduated transition area 10. They can also have an outlet 14 that extends to the central dome 13, which outlet projects approximately 0.2 mm to 4 mm into the concave section 9. This can also contribute to the stiffening of the concave section 9. According to an exemplary embodiment, the bottom section 5 has an odd number of grooves 11 and panel-like projections 12. In particular, the exemplary embodiment has seven grooves 11, which are distributed approximately uniformly over the periphery of the bottom section 5. Accordingly, in the concave section 9, seven panel-like projections 12 are also made, which are arranged in each case essentially centrically between two adjacent grooves 11.

Figure 5:
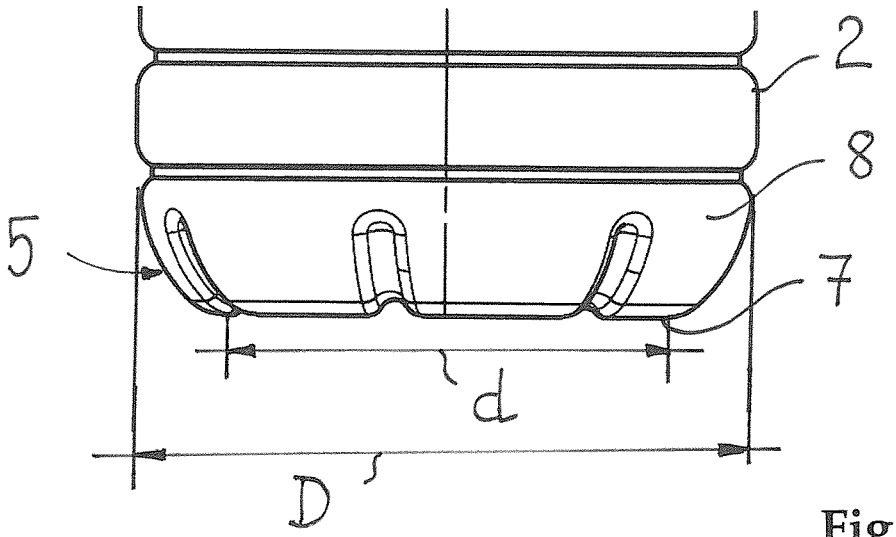
FIG. 5 shows a side view of the bottom section of the plastic container.

FIG. 5 shows a side view of the bottom section 5. The outside diameter at the transition of the edge area 8 of the bottom section 5 that is pulled up to the container body 2 is in turn provided with the reference symbol D. The mean diameter of the platform 7 bears the reference symbol d.

Figure 6:
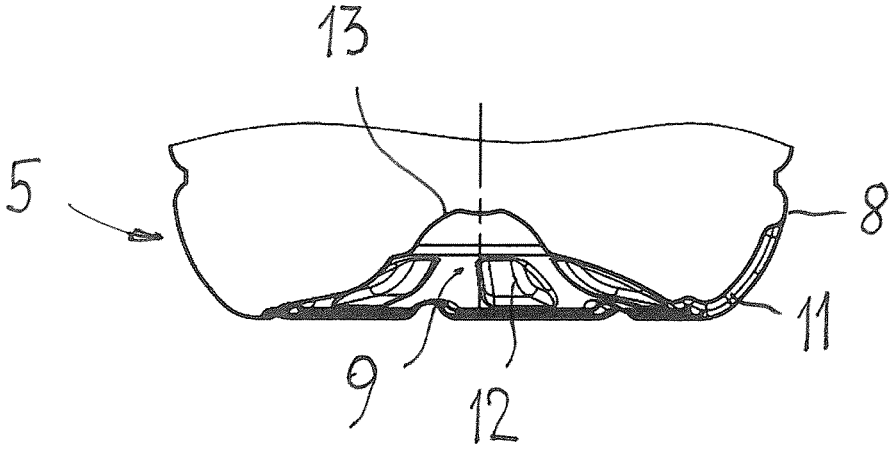
FIG. 6 shows an axial cutaway view of the bottom section of the plastic container.

The axial cutaway view of the bottom section 5 in FIG. 6 shows the central dome 13, which extends from the concave section 9 into the interior of the container. The axial extension of the central dome 13 corresponds approximately to an axial length of the edge area 8 of the bottom section 5 that is pulled up. The panel-like projections bear the reference number 12; the grooves are provided with the reference number 11.

The bottom section 5 of the plastic container 1 according to an exemplary embodiment of the disclosure configured in such a way that it withstands slightly elevated internal pressures of up to, for example, 1.5 bar compared to ambient pressure. Exceeding the slightly elevated internal pressure based on higher ambient temperatures can be compensated for by the limited flexible linking of the concave section 9 of the container bottom 6. As a result, deformations of the container body 2 can be avoided. By the combination of features of the bottom section 5 according to the exemplary embodiment of the disclosure, the specifications are met for reducing the wall thickness of the plastic container in particular in its bottom section 5, without a significant loss with respect to the strength, in particular the stiffness, of the plastic container thus having to be accepted. As a result, for example, the weight of known plastic containers, in particular plastic bottles, for storing cooking oil can be reduced from originally 17.2 g to 15.2 g.

It is understood that the disclosure is not limited to the explained embodiment of a plastic container, for example a plastic bottle for storing cooking oil. The combination of features according to the disclosure in the design of the plastic container, in particular its bottom section, is advantageous in the case of different types of plastic containers. Such plastic containers includes different cross-sections in the bottom section. Regular cross-sections, such as, for example, circular or essentially square cross-sections, are preferred. In an extrusion-blow-molding method, the plastic container can be produced from a plastic hose that is extruded continuously or intermittently. Because of the higher stretch-solidification that can be achieved, the plastic container that is designed according to the exemplary embodiment of the disclosure can be produced in a stretch-blow-molding method that includes a previously-produced elongated preshaped body. The preshaped body or preform can be manufactured in a different way. For example, injection-molding methods, impact-extruding methods, or else extrusion-blow-molding methods are used for this purpose.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A plastic container for storing liquid products under a low overpressure, the container comprising:

a container body extending along a longitudinal axis;

a container neck connected to one longitudinal end of the container body, the neck having at least one pour opening, a bottom section connected to another longitudinal end of the container bottom, the bottom section having a container bottom and an edge area that is pulled up on the sides and that turns into the container body, wherein in a direction of a container interior that is bounded by the container body, the container bottom has a curved concave section, whose periphery is connected via an axially projecting, graduated transition area to a platform that runs into the edge area that is pulled up on the sides, the graduated transition area including at least one step, the platform and at least one partial area of the graduated transition area interrupted by a first number of grooves, and the concave section having a second number of panel-like projections that project outwardly, which essentially extend between the graduated transition area and the longitudinal axis and end before the graduated transition area.

2. The plastic container according to claim 1, wherein the grooves extend into the edge area of the bottom section that is pulled up on the sides.

3. The plastic container according to claim 1, wherein the number of grooves and the number of panel-like projections are different from one another.

4. The plastic container according to claim 1, wherein the concave section of the container bottom comprises:

a central dome that extends into the interior of the container.

5. The plastic container according to claim 4, wherein the panel-like projections in each case end before a transition from the concave section to the central dome.

6. The plastic container according to claim 1, wherein an axial height(s) that is bridged between the concave section and the platform by the graduated transition area is 0.2 mm to 10 mm.

7. The plastic container according to claim 1, wherein an axial height(s) that is bridged between the concave section and the platform by the graduated transition area is 0.5 mm to 5 mm.

8. The plastic container according to claim 1, wherein the graduated transition area has an extension that runs essentially radially and that is 0.2 mm to 10 mm.

9. The plastic container according to claim 1, wherein the grooves have a depth, which is 0.5 mm to 5 mm.

10. The plastic container according to claim 1, wherein a depth of the grooves is the same as or greater than a height(s) of the graduated transition area that extends between the concave section and the platform.

11. The plastic container according to claim 1, wherein the grooves have an opening angle ($\alpha$), which is 20° to 50°.

12. The plastic container according to claim 1, wherein the panel-like projections have a maximum extension, measured in a vicinity of the graduated transition area, in the peripheral direction, which is 2 mm to 10 mm.

13. The plastic container according to claim 1, wherein the panel-like projections relative to the concave section have a maximum protrusion that is 0.5 mm to 5 mm.

14. The plastic container according to claim 1, wherein the platform has a width that extends essentially crosswise to the peripheral direction and that is 0.1 mm to 5 mm.

15. The plastic container according to claim 1, wherein the grooves have an outlet that extends in the direction of the longitudinal axis and that projects 0.2 mm to 4 mm into the concave section.

16. The plastic container according to claim 1, wherein the first number of grooves is odd.

17. The plastic container according to claim 1, wherein the bottom section has seven grooves distributed essentially uniformly over the periphery of the bottom section.

18. The plastic container according to claim 1, wherein the plastic container is a stretch-blow-molded container, produced from an elongated preshaped body.

19. The plastic container according to claim 1, wherein the graduated transition area is configured to perform a hinge or spring function for the concave section.

* * * * *